United States Patent [19]

Fremion

[11] Patent Number: 4,995,557

[45] Date of Patent: Feb. 26, 1991

[54] EAT-IN/CARRYOUT PIZZA BOX

[75] Inventor: Edwin A. Fremion, Chesterfield, Va.

[73] Assignee: Westvaco Corporation, New York, N.Y.

[21] Appl. No.: 514,600

[22] Filed: Apr. 26, 1990

[51] Int. Cl.[5] ..... B65D 5/28

[52] U.S. Cl. ..... 229/125.29; 229/23 BT; 229/125.32; 229/901

[58] Field of Search ..... 229/122, 901, 125, 29, 229/23 BT, 125.31, 125.32, 23 R

[56] References Cited

U.S. PATENT DOCUMENTS

| | | | |
|---|---|---|---|
| 2,316,457 | 4/1943 | Royce | 229/125.29 |
| 2,579,518 | 12/1951 | Schaefer | 229/901 |
| 2,776,083 | 1/1957 | Derman | 229/122 |
| 3,410,475 | 11/1968 | Wagner | 229/125.29 |
| 3,469,761 | 9/1969 | Howell | 229/901 |
| 4,444,354 | 4/1984 | Staelgraeve | 229/23 BT |
| 4,470,538 | 9/1984 | Heathcock et al. | 229/23 R |
| 4,474,324 | 10/1984 | Forbes, Jr. | 229/23 BT |
| 4,856,707 | 8/1989 | Lorenz | 229/125.29 |
| 4,877,178 | 10/1989 | Eisman | 229/125.29 |

FOREIGN PATENT DOCUMENTS

| | | | |
|---|---|---|---|
| 473010 | 7/1969 | Switzerland | 229/122 |

*Primary Examiner*—Gary E. Elkins

[57] ABSTRACT

A food package particularly adapted for packaging food products for eat-in or carryout service is prepared from a pair of combination tray/cover components made from identical blanks of paperboard or the like. Each tray/cover component comprises a base panel with opposed side walls and a rear wall which are retained in an upright condition by glue flaps attached to the rear wall and adhered to the side walls. The front wall remains in the same general plane of the base panel to form an open ended tray for eat-in use. For carryout use, two components are joined together wherein tabs on the ends of the front wall of one component are engaged in slots provided in the rear walls of another component to form a tray/cover combination.

3 Claims, 4 Drawing Sheets

21
17
23
26
25
16
14
12
10
11
13
15
18
24
22
20
19

29
30
17
11
26
28
15
19
27

EAT-IN/CARRYOUT PIZZA BOX

BACKGROUND OF INVENTION

The present invention relates to packaging and is particularly concerned with food packaging prepared from flat blanks of corrugated paperboard.

Generally, packaging components are manufactured for the specific products to be packaged Where food products are involved, sometimes the packages are designed for eat-in use and other packages are designed for carryout use. The requirements of different packages for eat-in and carryout means that someone who sells food products for both uses must maintain on hand dual inventories of packaging materials. Meanwhile it has heretofore been recognized that manufacturing and inventory requirements can be simplified by using a common blank to form two halves of the same package. U.S. Pat. No. 4,444,354 discloses a tray with a telescoping cover formed from identical blanks. U.S. Pat. No. 4,470,538 discloses a paperboard carton with common tray-cover components, and U.S. Pat. No. 4,474,324 (owned by the present assignee herein), discloses yet another telescoping carton made from identical blanks of paperboard. However, none of the aforementioned prior art patents disclose a package particularly suitable for two different uses, i.e., eat-in and carryout.

In this regard, the present invention is directed to a new and improved package construction in which the same component is used in combination to form a carryout package, or singly as an eat-in package for food products such as pizza. In its carryout mode, two like components are combined to form a tray and lid whereas in the eat-in version, only one component is used to form a tray. Unlike the prior art constructions that require separate sets of fold or score lines, which are selectively utilized depending upon whether an inner or outer package half is to be formed, the present invention provides a construction wherein the fold lines and folding sequence are the same for each component of the package. Thus the packaging components of the present invention are economical to make and the user need only carry one inventory for both carryout or eat-in service.

SUMMARY OF INVENTION

The present invention relates to a novel package for food products, and more particularly to a multi-use food package formed from separate cover and tray components wherein the cover and tray are each made from identical blanks of corrugated paperboard or the like. The combination tray/cover is cut and scored from a substantially rectangular blank of corrugated paperboard material, which is folded and glued by the manufacturer and shipped to the user in a partially set up condition. As received by the user, each combination tray/cover is in the form of an open ended tray which is capable of being stacked for inventory. Each combination tray/cover member is formed from a blank including a base panel with opposed side walls joined to the base panel along fold lines at opposed sides of the blank, and a rear wall which includes glue flaps at each end thereof joined to the base panel along a rear fold line at the rear of the blank. In addition, the blank includes a front wall joined to the base panel at the front of the blank along a front fold line. The glue flaps at each end of the rear wall are joined thereto along fold lines, portions of which are cut out to form slots adjacent to the corners where the side wall fold lines meet the rear wall fold line. Meanwhile, the front wall of each blank preferably includes an upper edge having a central portion which is cut away and a pair of tab members formed by extensions of the front wall at the outer portions of each end thereof. For use as a tray member, the rear and side walls are folded upwardly at substantially ninety degree angles with respect to the base panel and the glue flaps attached to the rear wall are adhered to the inside of the adjacent ends of the side walls. The front wall, meanwhile, remains unfolded so as to lie in substantially the same plane as the base panel as a front extension thereof. Thus the tray member constitutes an open tray structure with opposed side walls, a rear wall and an open front. In this configuration the tray is useful as an eat-in package for pizza or the like.

In the combination cover/tray mode for carryout service, two trays as described above are combined to provide an enclosed package. For this purpose, the extended front wall of a first tray component is placed adjacent to and on the inside of the rear wall of a second tray component. In this position, the front wall of the first tray component is slid downwardly until such time that the tab members at the outer ends thereof become engaged within the slots provided therefor at the rear corners of the second tray component. This action produces a combined cover and tray into which a pizza or the like may be placed for carryout. After placing the pizza in the package, the lid is folded over and locked in a closed condition by folding the front wall of the second tray upwardly and overlapping it with the rear wall of the first tray where the tabs on the ends of the second tray front wall become engaged in the slots at the rear corners of the first tray. Thus, the front and rear of the package become locked together in a similar manner.

Since both the tray component and cover component are substantially the same size, a frictional fit occurs which tends to maintain the integrity of the combination package. Both components are shipped to the user in a partially formed, stacked array where the user may decide which will be a cover and which will be a tray. If desired, appropriate graphics may be provided on the respective components to indicate which is a cover and which is a tray. Since the package of the present invention is intended for the fast food market, such graphics would make obvious which component to use.

DETAILED DESCRIPTION

Figure 1:
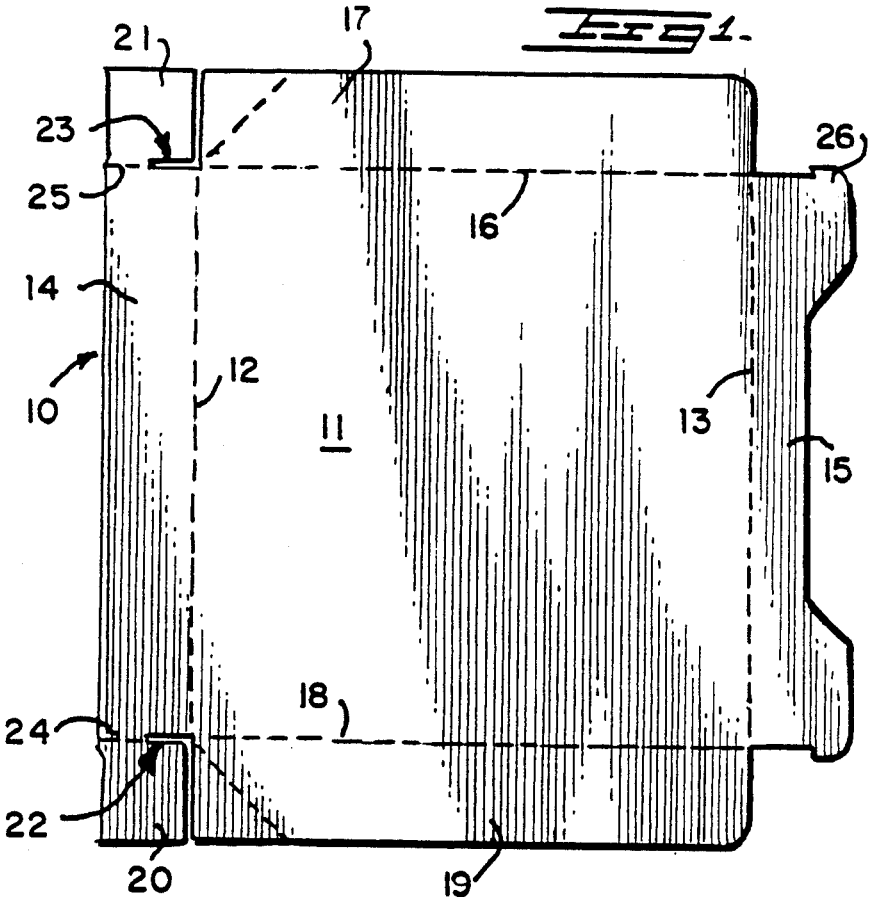
FIG. 1 is a plan view of a typical blank for making the combination tray/cover of the present invention.

Referring now to the drawings, the combination tray/cover of the present invention may be formed from a blank 10 substantially as shown in FIG. 1. The blank is preferably of generally rectangular shape and is formed from corrugated paperboard, although it may take any other desired shape and could be formed from other stiff paperboard-type materials. The blank 10 includes a centrally located base panel 11 formed by opposed score lines 12, 13 and 16, 18. A pair of side walls 17 and 19 are foldably connected to the sides of the base panel 11 along score lines 16 and 18. A rear wall 14 is foldably attached to the rear of the base panel 11 along score line 12 and a front wall 15 is foldably attached to the front of the base panel 11 along score line 13. The rear wall 14 includes a pair of glue flaps 20, 21 foldably attached to the opposite ends thereof along score lines 24, 25 respectfully. The score lines 24, 25 are each partially cut away to form slots 22, 23 at the rear corners of the base panel 11 adjacent to the side walls 17 and 19. Meanwhile the front wall 15 preferably has a central portion cut away at the top edge thereof as shown and further includes tab elements 26, 27 formed at the opposite ends thereof as extensions of the side edges of front wall 15. The central cut away portion of front wall 15 is primarily decorative.

Figure 2:
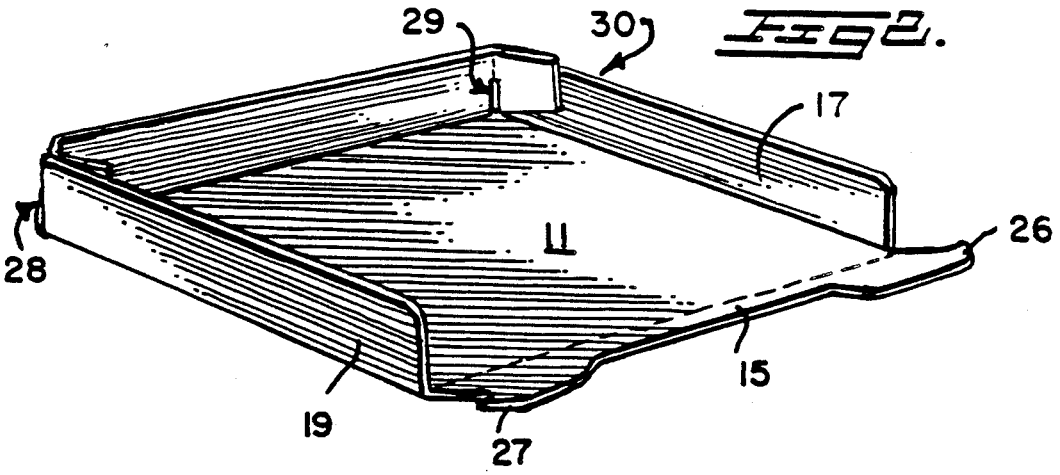
FIG. 2 is a perspective view of a tray component formed from the blank of FIG. 1.

The blank 10 is formed into its tray/cover configuration as shown in FIG. 2 by initially folding rear wall 15 upwardly ninety degrees about score line 12, and folding the glue flaps 20, 21 inwardly where adhesive is applied thereto. Subsequently, the side walls 17 and 19 are folded upwardly about score lines 16 and 18 and the rear ends thereof adhered to the glue flaps 20, 21 on rear wall 15. The front wall 15 remains substantially in the plane of the base panel 11 at the front of the tray 30 as shown in FIG. 2 which, makes it easy to place a pizza into the tray for eat-in service. When folded and glued as shown in FIG. 2, the tray 30 includes a pair of slots 28, 29 at the rear corners thereof which are formed by the slotted areas 22, 23 along the rear wall score lines 24, 25. These slots 28, 29 play an important role in converting the package for carryout service.

Figure 3:
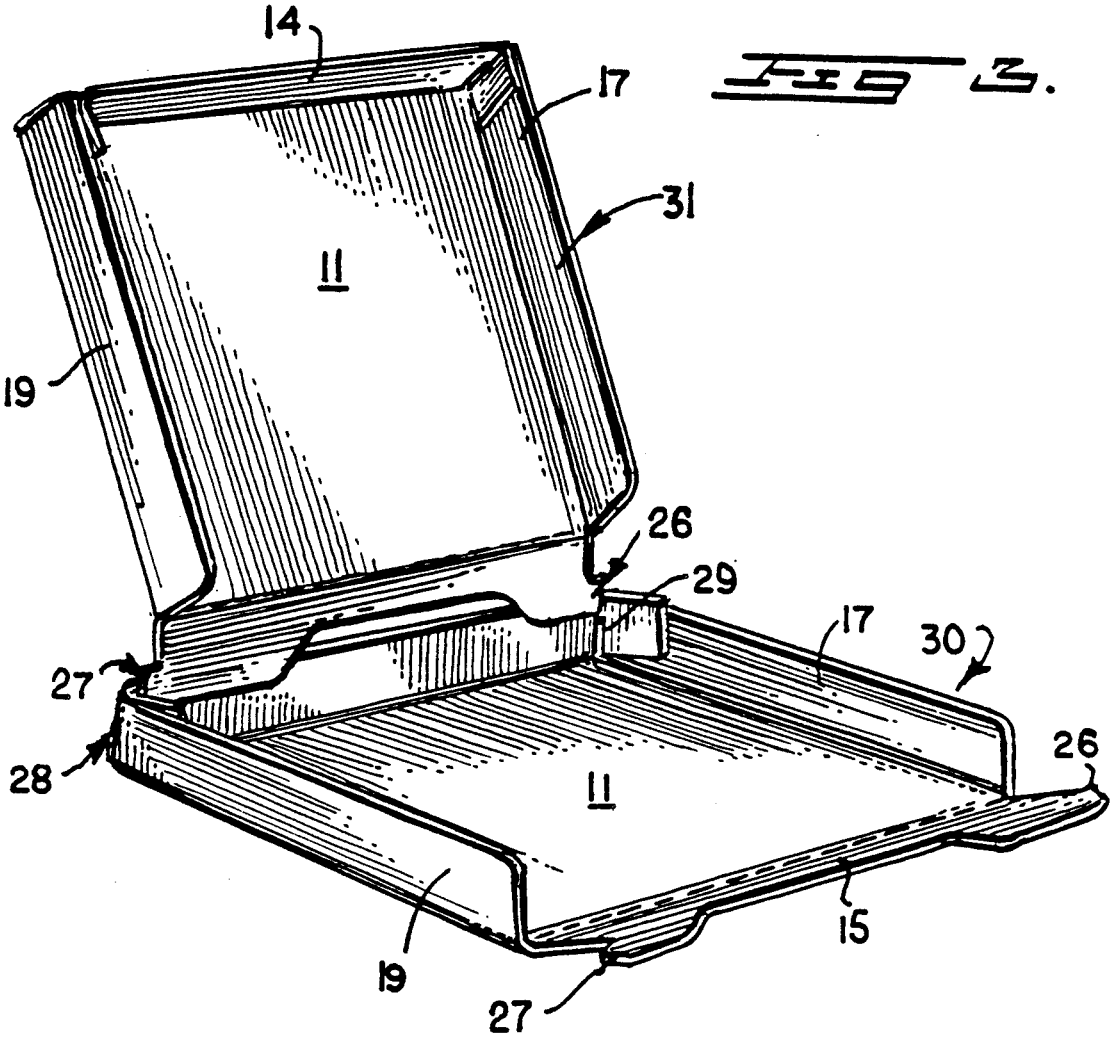
FIG. 3 is a perspective view of a tray and cover combination partially engaged.
Figure 4:
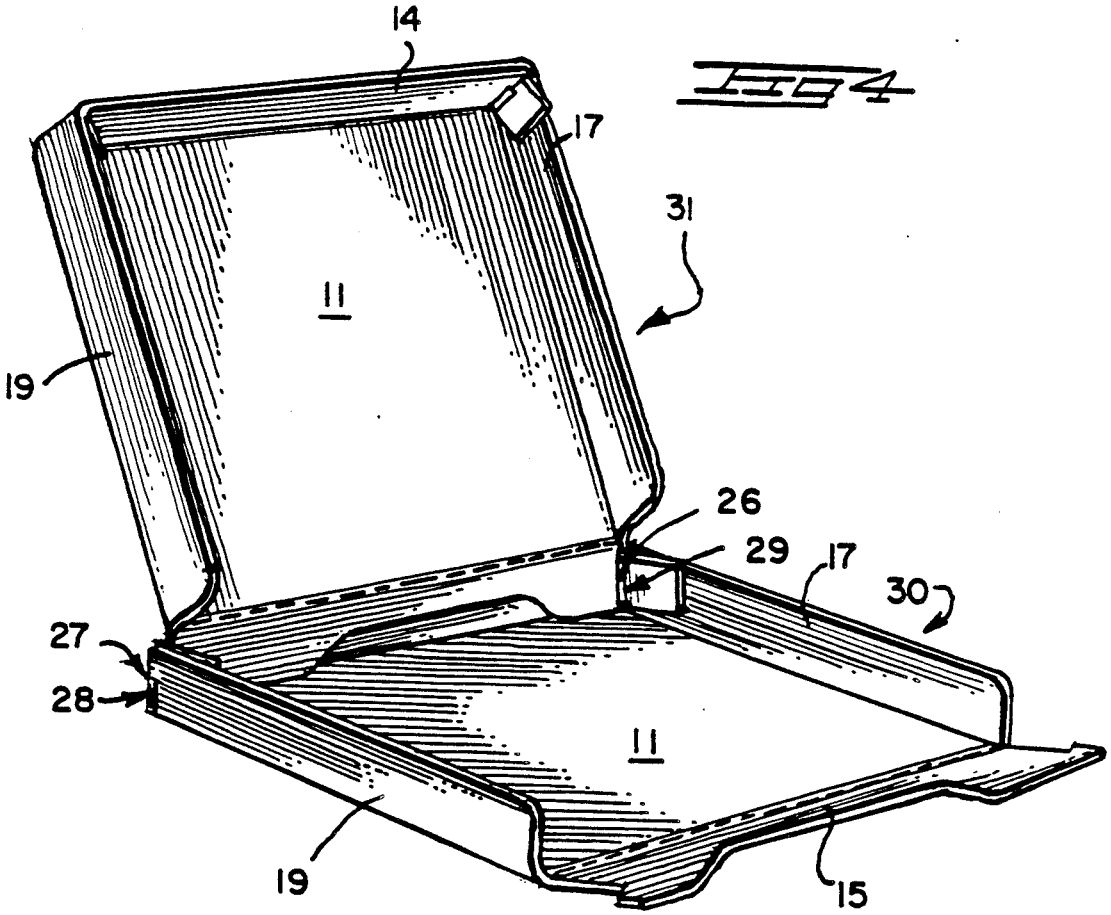
FIG. 4 is a view like FIG. 3 showing the components fully engaged to make a complete package.
Figure 5:
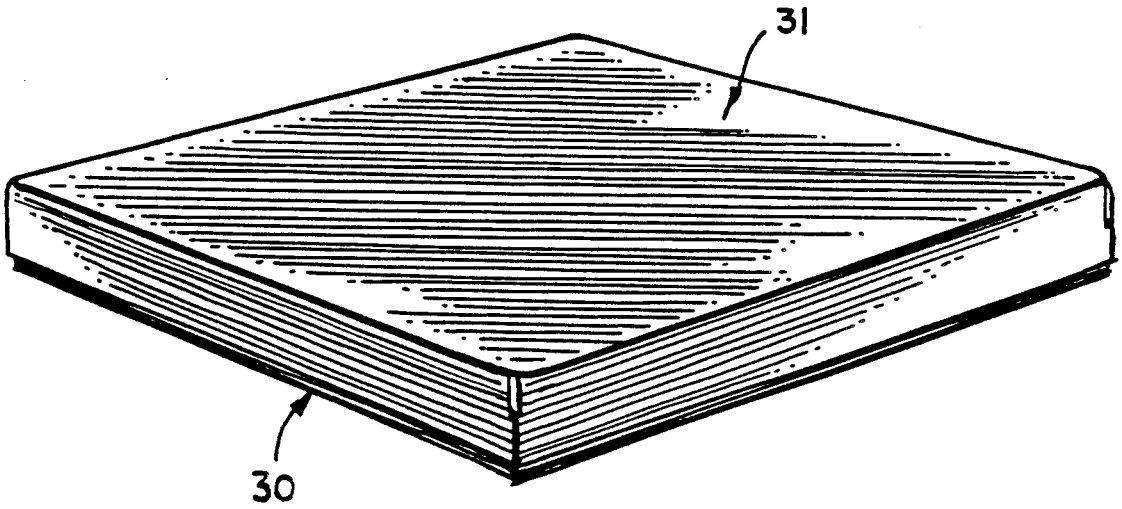
FIG. 5 is a perspective view of a closed package.

A first step in converting the package of the present invention for carryout service is shown in FIG. 3. For this purpose, two tray/cover components 30, 31 are engaged as shown by positioning the front wall 15 of cover component 31 inside of and adjacent to the rear wall 14 of tray component 30. In this position, the front wall 15 of cover 31 is moved downwardly adjacent to rear wall 14 of tray 30 until the tab elements 26, 27 become engaged in the slots 28, 29. At this point, a completed package is formed as shown in FIG. 4 with a combined cover and tray for carryout service. After the pizza or other food product is placed in the package, the carton is closed by folding the front wall 15 of tray 30 upwardly and overlapping the front wall 15 with the rear wall 14 of cover component 31 wherein the tab elements 26, 27 on tray 30 become engaged in the corresponding slots 28, 29 of cover component 31. A snug fit is insured because the two components are of generally the same shape and size. However, the carton can readily be opened by reversing the closing steps outlined above.

It will be understood that modifications may be made in the package disclosed herein by those skilled in the art without departing from the spirit and scope of the invention as defined in the claims, and that the foregoing description is merely illustrative of the invention. Therefore, it is intended that the invention be construed as broadly as possible consistent with the scope of the appended claims.

What is claimed is:

1. A combination cover/tray component for use with another identical cover/tray component, said component being formed from a unitary blank of foldable sheet material, comprising:

(a) a centrally located base panel of generally rectangular shape having a front edge, a rear edge, side edges and front and rear corners at the intersections of said edges, a pair of opposed side walls having inside and outside surfaces and front and rear portions foldably attached to the side edges of the base panel;

(b) a rear wall having ends foldably attached to the rear edge of the base panel; and, (c) a front wall having ends foldably attached to the front edge of the base panel, the improvement wherein the rear wall includes a glue flap foldably attached along a fold line to each end of the rear wall which is adhered to the inside surface of the rear portion of each adjacent side wall, a pair of slots formed at the rear corners of the base panel along the fold lines connecting the glue flaps to the ends of the rear wall, and a pair of tab elements located at the ends of the front wall was extensions thereof.

2. A combination tray/cover component for an eat-in/carryout food package, said component comprising a structure having a centrally located base panel of generally rectangular shape having a front edge, a rear edge, side edges and front and rear corners at the intersections of said edges, a pair of upstanding side walls having inside and outside surfaces along opposed side edges of the base panel, an upstanding rear wall along the rear edge of said base panel and a front wall along the front edge of said base panel that lies in the plane of the base panel in the tray configuration of said component, a glue flap foldably attached along a fold line to each end of said rear wall and adhered to the inside surface of each adjacent side wall at each rear corner of said base panel, a pair of slots at the rear corners of said base panel, said slots being formed along the fold lines connecting said glue flaps to the rear wall, and a pair of tabs located at the ends of said front wall formed by extensions of said front wall.

3. Packaging comprising in combination a tray component and a cover component, each component being fabricated from an identical flat blank of foldable sheet material, each component having a base panel with four corners, four side edges, a pair of opposed side walls, a rear wall with opposed ends and a front wall with opposed ends, the improvement wherein tab elements formed on the ends of each front wall of each component are engaged within slots formed at the ends of each rear wall of the same component to provide an enclosed package for carry out food products.

* * * * *